United States Patent [19]

Weinrib

[11] Patent Number: 4,792,275

[45] **Date of Patent: * Dec. 20, 1988**

[54] PUMP CONSTRUCTION

[75] Inventor: Harry P. Weinrib, Chicago, Ill.

[73] Assignee: Eddy Pump Corporation, Lincolnwood, Ill.

[ * ] Notice: The portion of the term of this patent subsequent to Jun. 24, 2003 has been disclaimed.

[21] Appl. No.: 946,307

[22] Filed: Dec. 24, 1986

[51] Int. Cl.[4] ..... F01D 1/08

[52] U.S. Cl. ..... 415/53 R; 415/120; 415/213 A; 415/88

[58] Field of Search ..... 415/52, 53 R, 83, 88, 415/89, 120, 213 R, 213 A, 219 C, 213 T, 198.2; 416/197 R, 243

[56] References Cited

U.S. PATENT DOCUMENTS

| | | | |
|---|---|---|---|
| 666,191 | 1/1901 | Galbraith | 416/197 |
| 1,945,759 | 2/1934 | Sim | 417/67 |
| 2,148,131 | 2/1939 | Parker | 417/54 |
| 2,480,969 | 9/1949 | Rosa | 417/76 |
| 2,690,130 | 9/1954 | Boeckler | 417/83 |
| 3,072,057 | 1/1963 | Da Silva Rosa | 417/90 |
| 3,093,080 | 6/1963 | Tarifa et al. | 415/24 |
| 3,151,560 | 10/1964 | Da Silva Rosa | 417/69 |
| 3,304,066 | 2/1967 | Vieceli et al. | 415/88 |
| 3,477,383 | 11/1969 | Rawson et al. | 415/177 |
| 3,519,365 | 7/1970 | Conhagen | 415/88 |
| 3,776,658 | 12/1973 | Erickson | 415/88 |
| 3,791,757 | 2/1974 | Tarifa et al. | 415/88 |
| 3,809,491 | 5/1974 | Banyai | 415/88 |
| 3,817,659 | 6/1974 | Erickson et al. | 417/84 |
| 3,945,761 | 3/1976 | Araoka | 416/243 |
| 4,161,448 | 7/1979 | Erickson et al. | 417/84 |
| 4,278,397 | 7/1981 | Bachl | 415/83 |
| 4,596,511 | 6/1986 | Weinrib | 415/213 A |
| 4,646,483 | 3/1987 | Mangan | 416/197 X |

FOREIGN PATENT DOCUMENTS

| | | |
|---|---|---|
| 971042 | 11/1958 | Fed. Rep. of Germany . |
| 42116 | 4/1959 | Poland . |
| 937785 | 10/1980 | U.S.S.R. . |
| 840486 | 6/1981 | U.S.S.R. . |

*Primary Examiner*—Robert E. Garrett
*Assistant Examiner*—Joseph M. Pitko
*Attorney, Agent, or Firm*—Fitch, Even, Tabin & Flannery

[57] ABSTRACT

A pump is provided within a vortex generator having a plurality of equally spaced blades which rotate in a pump casing to form a nucleus of fluid in the shape of an ellipsoid having an upper tapered end and a lower tapered end with a thicker central section at the blades. Fluid flows in a synchronized flow from the lowered tapered end of the nucleus in a rotating vortex column of fluid which initially flows out of the pump inlet to swirl the ambient fluid about the inlet and causes a low pressure area and a swirling of the ambient fluid to flow inwardly through the pump inlet in a direction counter to the vortex column flow. A belt of fluid rotates between the nucleus and the pump casing. The blades are curved to retain fluid in the nucleus and momentum energy is cumulatively applied to keep the swirling column of fluid swirling through the pump outlet. A tapered section on the pump between the pump inlet and pump outlet assists in flow therebetween. A divider may be provided in the pump casing with an opening in the divider to allow the vortex column to flow from a vortex generating chamber to a pump discharge chamber while debris hits the divider and is prevented from flowing into contact with the blades. Pressure boosters may be added to the blades.

25 Claims, 4 Drawing Sheets

PUMP CONSTRUCTION

This invention relates to an improved method and apparatus for pumping fluids.

BACKGROUND OF THE INVENTION

This invention is directed to in improvement in the pump apparatus and method disclosed in U.S. Pat. No. 4,596,511 which discloses an Eddy Pump invented by Harry P. Weinrib. The aforesaid pump works on a unique principle of generating a swirling vortex column of liquid by a vortex generating member instead of the usual conventional impeller. The vortex generating impeller illustrated in the patent has a plurality of flowing streams flowing through narrow ducts or passageways to a central axis at which the streams are combined into the vortex column of fluid having a high angular velocity and a high outward velocity component which is directed through the pump inlet into the ambient fluid where its energy is dissipated and where its energy swirls the ambient liquid and/or solids causing a counter flow of the fluid in the opposite direction inwardly through the pump inlet and about the counterflowing vortex column.

Pumps operating in accordance with the above description and in accordance with the principles disclosed in U.S. Pat. No. 4,596,511 have been successfully operated in a number of different environments including the pumping of water, pumping of gravel, pumping of dredged blue clay from a harbor bottom and pumping of heavy viscous sewage sludge having a solids content of 10 to 15 percent solids by weight. It has been found particularly when pumping very viscous materials such as sludge that the narrow restricting passageways in the vortex generating means or runner shown in U.S. Pat. No. 4,596,511 may become clogged with sludge.

When dredging, various diverse materials including rocks, gravel, man-made debris and other materials, some of which could be wedged in the narrowing passageways in the vortex generating runner when traveling through vortex generating runner. In such event, there could be considerable downtime cost or loss of efficiency due to such blocking of the passageway. Also, the direct impingement of the sand, gravel, debris and other abrasive material against the rotating vortex generating runner may cause a fast wearing of the runner and it may be desired to be avoided.

Further, the pump disclosed in U.S. Pat. No. 4,596,511 illustrates a helical mainstream column of fluid which flows from the pump inlet directly toward the rotating runner and then this material is turned through a right angle turn to flow from the illustrated pump. Manifestly, the entire casing is filled with swirling fluid and this non-mainstream fluid interchanges with the mainstream fluid which flows through a short path between the pump inlet and the pump outlet. This mainstream fluid is a helically swirling fluid which must be changed through the right angle; and it has been found, that improved results in flow may be obtained by eliminating this right angle flow of the mainstream swirling helical liquid which swirls as it flows from the pump discharge pipe.

Accordingly, an object of the present invention is to provide a new and improved pump apparatus and method to overcome the above described problems.

A still further object of the invention is to provide an eddy pump of improved construction.

These and other objects and advantages of the invention will become apparent from the following detailed description when taken in connection with the accompanying drawings and which:

Figure 1:
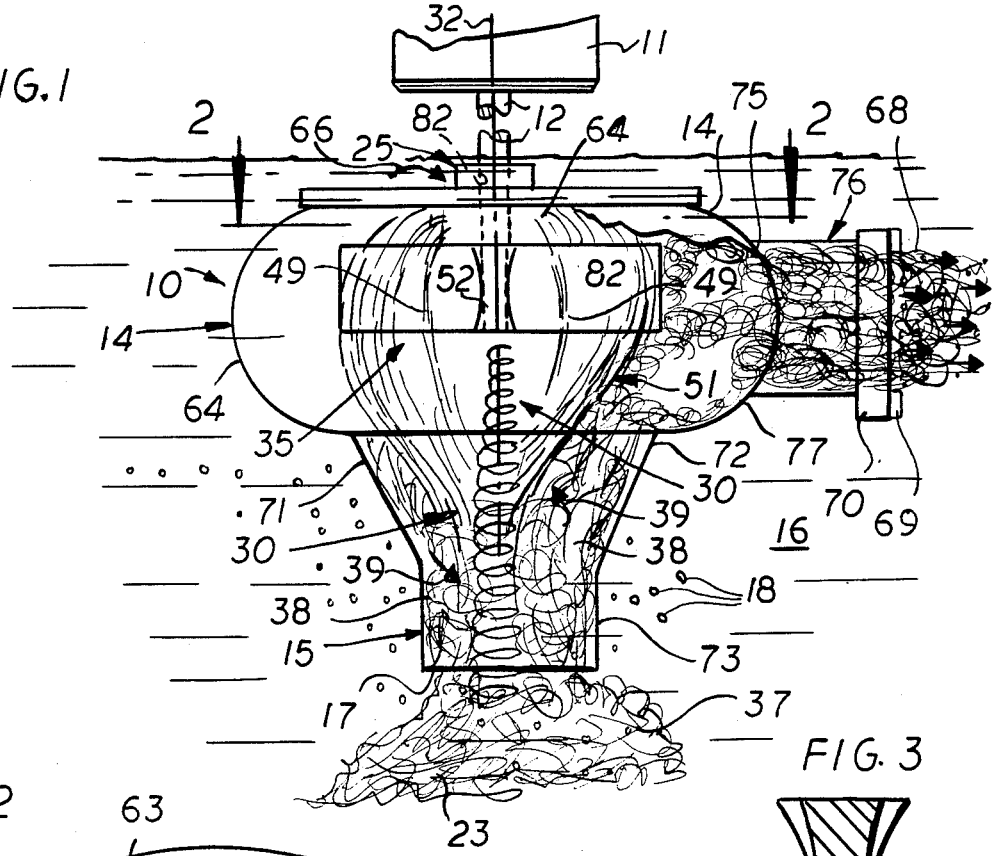
FIG. 1 is an elevational view of the pump embodying the novel features of the invention.

As shown in the drawings, for purposes of illustration, the invention is embodied in a pump 10 having a drive motor 11 with the driving shaft 12 extending to the pump hose or casing 14. The pump has a pump inlet in the form of an inlet conduit 15 which extends into a body of fluid 16 such as a liquid having solid particles 18 therein for lifting the liquid and entrained solids into the pump casing from which the liquid is discharged through a pump outlet 18.

While the present invention is described hereinafter in connection with the illustrated vertical orientation of the pump, it is to be understood that the pump is capable of being oriented in various directions and that the vertical orientation given herein is merely by way of illustration and is not to limit the pump to any particular orientation. While the pump herein is usually submerged and hence primed with liquid, the pump can be operated without being submerged or primed.

As disclosed in the U.S. Pat. No. 4,596,511, a vortex generating means or runner 35 is located within the pump casing 14 and has a hub 25 connected to the motor shaft 12 to be rotated about a longitudinal vertical axis 32 through the pump shaft 12 which is located on the same vertical axis 3 through the pump casing 14. As fully described in the aforesaid patent, the rotating vortex generator 35 generates a vortex column 30 of fluid directed from the runner downwardly through the pump inlet 15 for discharge at the pump inlet orifice 17 to form a spreading vortex cone-shaped area 37. In the aforesaid patent, the vortex generator includes a plurality of inwardly extending narrow passageways which have wider and larger cross-sectional areas at inlets located at periphery of the runner through which inlets the fluid flows inwardly toward the rotational axis of the runner. The separate flowing streams are combined at a common nucleus or area and then discharged downwardly as a combined rotating vortex column 30 located on the runner axis 32.

As above described, these narrowing passageways in the pump illustrated in U.S. Pat. No. 4,596,522 may become clogged, or restricted with rocks, or other debris when used in a dredging operation, or may become plugged with heavy viscous sewage sludge having a solids content in excess of ten percent by weight. Also, in the aforesaid patent, the illustrated pump has the incoming fluid and debris flowing directly at the rotating vortex generating runner so that there is a greater likelihood of impingement of abrasive debris against the runner and greater incidence of wear; and there is a loss of efficiency by turning the fluid through a right angle turn from the pump inlet to the pump outlet.

Accordingly, the present invention is directed to overcoming these aforesaid clogging, wear add flow directional problems and to provide a new and improved pump over that disclosed in U.S. Pat. No. 4,596,511.

Figure 14:
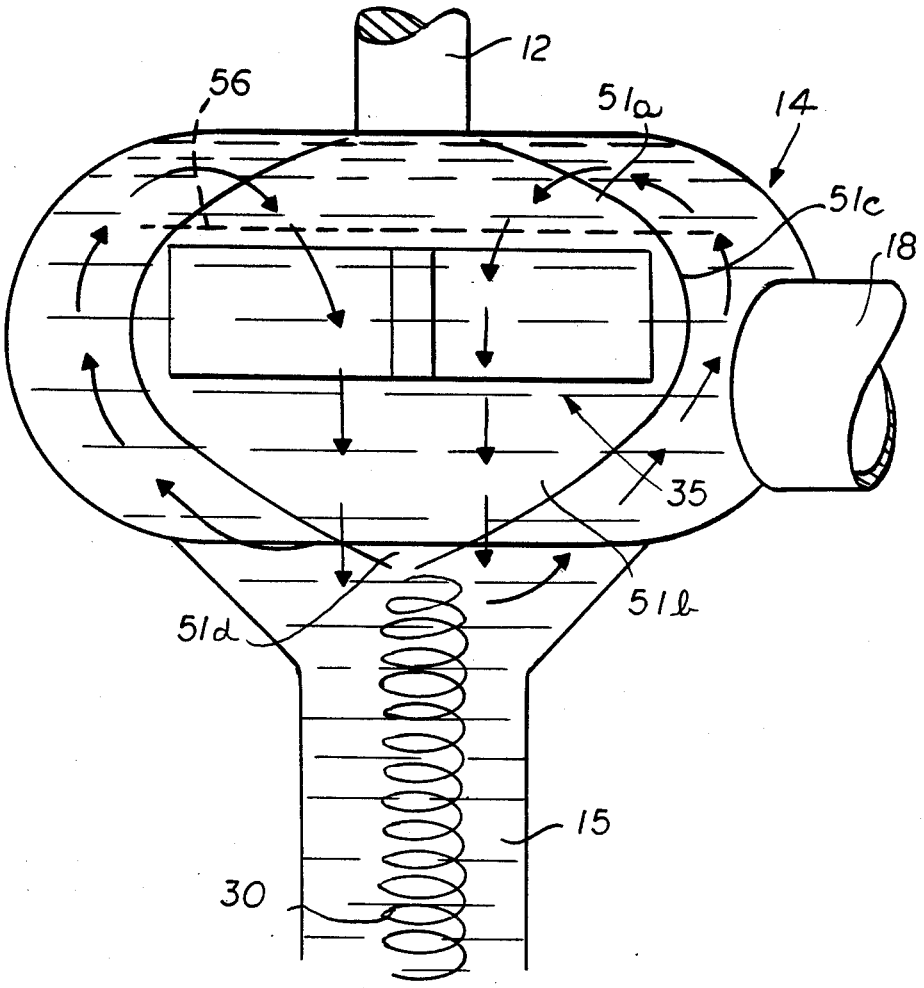
FIG. 14 is a diagrammatic illustration of fluid in the pump.

In accordance with the present invention, the clogging of material within the narrow passageways of the vortex generator has been eliminated by forming the vortex generator 35 with very large open passageways 48 between adjacent pairs of generating members or blades 52. Herein, the illustrated vortex generator 35 is in the form of a cruciform-shaped runner having four blades 52 disposed at right angles to one another and space for passageway 48 between adjacent blades 52 is open at the top and open at the bottom. The rotation of the blades 52 by the motor 11 and drive shaft 12 rotates the vortex generator about the vertical axis 32 through the shaft 12. The four blades 52 rotate and form a ellipsoidal-shaped nucleus 51 of fluid within in the passageways 48 between the blades. The ellipsoidal nucleus includes an upper conical portion 51*a*, as best seen in FIG. 14, and a lower conical portion 51*b*. The fatter central portion 5*/c* of the ellipsoidal-shaped nucleus extends slightly beyond tips 60 of the rotating blades. The nucleus of rotating fluid thus includes the fluid between the blades 52 and additional swirling fluid above and below the blades swirling at about the same general rotational velocity as the fluid in the passageways 48 between the blades. Fluid generally flows down from each of the passageways 48 toward the lower end 51*d* of the nucleus from which is initially formed the synchronized vortex column 30 that travels down through the pump inlet 15 into the ambient fluid.

The nucleus 51 can be replenished with fluid flowing upwardly towards the upper end 51*a* of the nucleus and then flowing down between the blades 52 to the lower end of the nucleus. The nucleus at the lower end is like a concentric beam of rotating fluid with the fluid from between the blades 52 traveling down to form a synchronized beam or vortex column traveling down and discharging to the inlet of the inlet 15. The vortex column swirls the ambient fluid about the inlet and if closely adjacent a bed of gravel or clay 23 will lift particles 18 thereof to swirl upwardly with the ambient fluid to flow upwardly and radially outwardly of the vortex column 30. This upward swirling column swirls ambient fluid into the casing and into a belt 63 of fluid swirling about the nucleus and between the nucleus and the casing wall 64. There is a pressure gradient across this belt from the nucleus. The higher positive pressure is within the nucleus and the lower positive pressure is adjacent the casing wall 64 of the rotating belt 63 of fluid. Positive pressure exists within the pump casing except at upper end of the hub 25 and for a small distance around the hub after which positive pressure is again present.

After the vortex column 30 has fully established the upward swirling column 38 of liquid, this swirling column flows in a mainstream flow across to the pump outlet 18 for discharge from the pump casing. The vortex column 30 should no longer travel completely through the inlet 15 after complete establishment of the upward flow and the swirling belt 6. However, the vortex column or synchronized beam will always be at the center of the upward flowing stream and always applying energy to the center of the rotational stream flowing through the inlet pipe. The initial vortex column overcomes the inertia of the fluid about the inlet orifice and causes the fluid to swirl add rotate and lift up the ambient fluid, after which the synchronized beam need not extend through the pump inlet orifice 17 into the ambient fluid. Manifestly, the upwardly flowing liquid in the inlet 15 replenishes liquid leaving the belt 63 and partially the nucleus 51.

Figure 3:
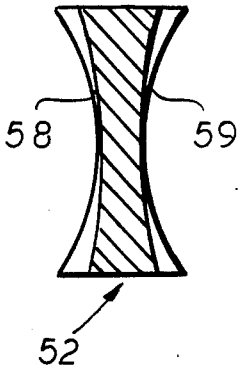
FIG. 3 is an enlarged cross-sectional view taken substantially along the line 3—3 in FIG. 2.
Figure 4:
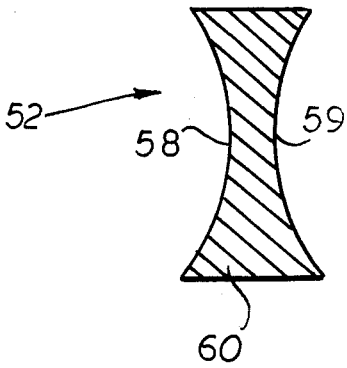
FIG. 4 is a cross-sectional view taken substantially along the line 4—4 in FIG. 2.

When the pump is operating after its initial period of start-up, the nucleus can be viewed as providing momentum energy to the mainstream flow and may be viewed as maintaining rotational power at the upward flow and combines with the rotating belt liquid as it flows across the shortest distance path to the pump outlet. The momentum energy from each of the four blades 52 is transferred in a cumulative manner, are added to one another, to provide a resultant sum of momentum energy that is very significant because of limited re-circulation of liquid and its synchronization. In contrast, prior art pumps of the so-called vortex type have a disk or shroud located at the dotted line 56 shown in FIG. 14 which would chop off the upper portion 51*a* of the nucleus. The disc or shroud then causes formation of a pressure differential at places about and below the shroud and causes re-circulation of flows that intersect and counteract with one another and with the main flow which is to throw the liquid radially outward. Thus, the momentum energy imparted to these non-synchronous flows are not added to one another to create this synchronous beam and nucleus 51 described for this invention. To capture the liquid or fluid and to focus it to stay between adjacent blades 52, the latter are provided with the curved surfaces 58 and 59, as best seen in FIGS. 3 and 4 on opposite sides of the blades. Also, to aid in directing the fluid inwardly through narrowing passageways 38, it is preferred that outer free or distal ends 60 of the blades 52 be wider in cross section than the inner blade ends connected to the hub 25. Thus, for instance, it is seen that the blade cross section in FIG. 4 taken outwardly adjacent the tip 60 is thicker than the cross section shown in FIG. 3 which is taken near the center portion of the blade 52.

Thus, the blades 52 of the runner 35 combines four fluid streams and forms the vortex column 30 because there are no counter currents or areas of large pressure gradient as would be occurring if a flat disk or plate was secured to the top of the runner blades 52. Upon such a plate being present, there would be a pressure differentiation between the top plate 14*b* and the disk and on the underside of the disk and this pressure gradient will cause re-circulation of fluid around impellor which will interrupt the formation of the synchronized vortex column 30. The present invention is unique in that there is provided another outer band 63 of high pressure liquid which is swirling about the annular wall or surface 64 of the casing with the frictional rubbing thereagainst. It has been found that there is a high positive pressure at this annular rotating belt 63 of fluid. At the top of the rotating runner around the hub 25, there is a slight negative pressure which tries to draw fluid inwardly, as shown by the directional arrows 66 in FIG. 1.

As in the aforesaid patent, discharging vortex column 30 has been found to actually break and lose blue clay from a harbor bottom 23 and the liquid vortex may eliminate the need for a conventional cutter to cut he material. Also, when pumping sludge, the discharging column at the vorte area 37 imparts so much swirling energy and motion to the viscous sludge at the area 37 that it reduces its viscosity substantially because the sludge is a thixotropic material. Hence, the swirling sludge flows more readily upwardly through the pump inlet 15. The upward flowing outer annular column 38 of fluid also flows in the same angular direction as shown by the arrows 39 in FIG. 1 and about the column. This helical swirling action continues through the discharge pipe 18, and indeed, continues through an exhaust conduit 68 having a flange 69 connected to the exhaust flange 70 of the pump discharge conduit 76 such that the swirling action is clearly visible in most instances 100 or more feet down the discharge pipe 68.

Figure 2:
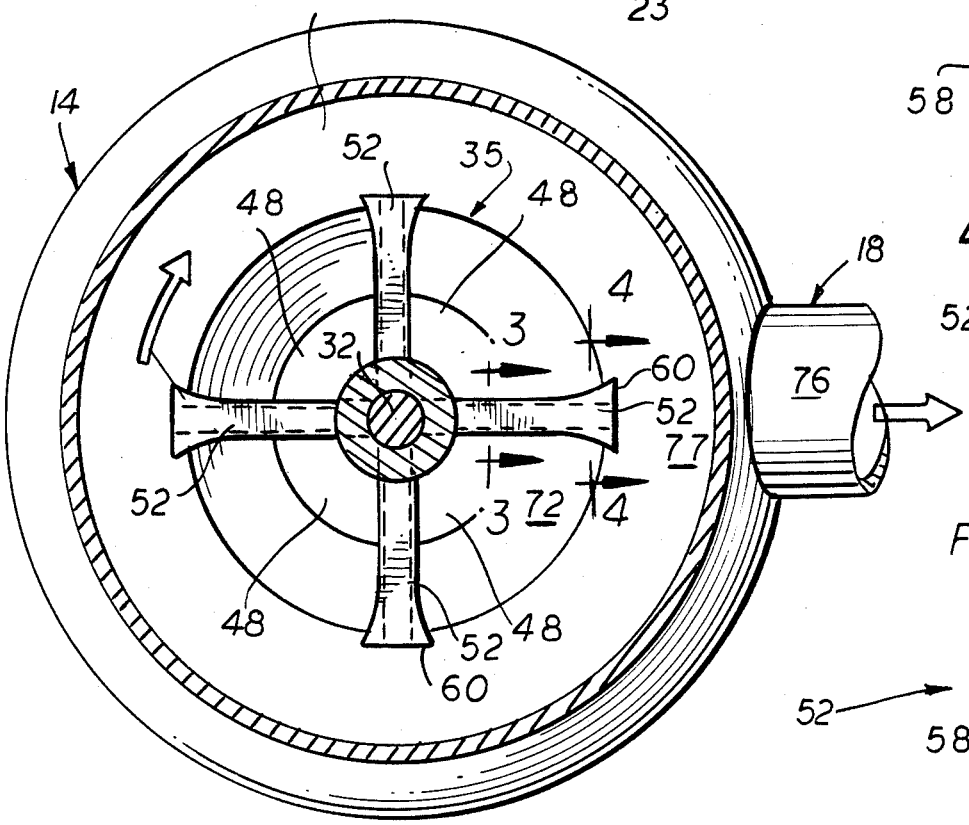
FIG. 2 is an enlarged cross-sectional view taken substantially along the line 2—2 of FIG. 1.

In accordance with an important aspect of the present invention, the mainstream portion of the swirling column 38 is assisted in its travel from the pump throat, i.e. the pump inlet to the pump outlet 18 by forming the pump inlet with a frusto conical section or means 71 which has an inclined wall 72 which is inclined from the lower vertical tubular portion 73 of the pump inlet 15 to its joinder seam 74 with the pump casing wall 64. There is an elliptical shaped opening 75 formed in the pump casing wall 64 to which is welded or integrally attached the circular discharge pipe 74. Thus, as is seen in FIG. 2, the mainstream portion of the helically swirling fluid in column 38 flows upwardly through the pump inlet tubular portion 73 to the frusto-conical portion and then travels primarily over the inclined wall 72 section located closely adjacent the outlet pipe 76 add over a short pump casing section 77 as diagrammatically illustrated in FIG. 72. The inclination of the frusto-conical wall section 72 reduces resistance to the swirling helically flowing fluid because there is no longer the 90° bend or turn requirement for the mainstream incoming liquid as was the case of the illustrated pump in U.S. Pat. No. 4,596,511. Preferably, the upper end 74 the frusto conical wall is located at and about in a vertical plane with the tip edges 60 of the runner blades 52 so as to leave the outer annular belt of liquid 63.

The illustrated vortex generating means 35 thus includes four metal blades 52 which are attached to a center shaft 80 which has a stub end 81 received in a hollow bore 82 of the hub 25 with the lower end of the shaft 12 being received in the upper end of the bore 85 in the hub 25.

Manifestly, the particular construction of the illustrated vortex generating means may be very substantially changing a number of runners from three to six or more. Likewise, the particular shape of the blades 52 may be changed from that illustrated herein and still fall within the perview of the present invention. The preferred number of blades 52 is four at 90° spacing. When three blades 52 were tried, the nucleus could be formed but it appeared that the 120° spacing allowed the liquid to flow too readily from the nucleus 51. When five or six blades are formed, it appears that there was too much metal or too much blade metal in the nucleus as with four blades that interferes with creating of synchronized vortex current.

Figure 5:
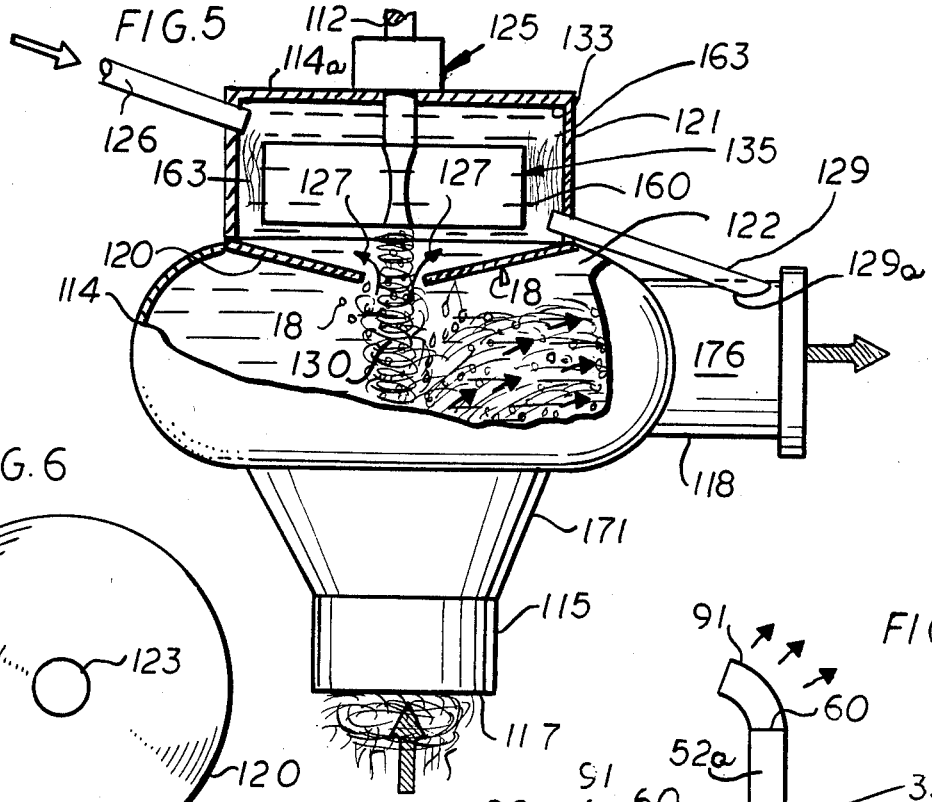
FIG. 5 is a partial section and broken away elevational view of a pump having a divider and constructed in accordance with another embodiment of the invention.
Figure 6:
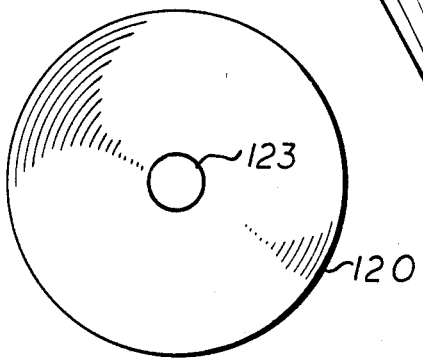
FIG. 6 is a plan view of the divider used in the pump of FIG. 5.

Another embodiment of the invention is illustrated in FIG. 5 in which the reference character 1 has been added as a prefix to the reference characters previously used to describe the invention shown in FIGS. 1–4. When the ambient liquid 16 contains a large number of solids and rocks 18, as shown in FIG. 5, the rocks or debris could wear or otherwise damage the vortex generating member 135 if allowed to strike the same directly.

In accordance with the invention shown in FIG. 5, the likelihood of any solids 18 or rocks or other material directly impinging on the vortex generating member 135 is diminished substantially by the use of a divider 120 which divides the pump casing into an upper protected vortex generating chamber 121 and a lower pump discharge chamber 122. The illustrated divider has a central circular opening 123 through which the vortex column 130 flows from the vortex generating means to flow downwardly and outwardly of the pump inlet orifice 117 from the pump inlet 115. The upward counter flowing column 137 bearing the solids 18 then flows over the frusto conical section 171 of the pump inlet 115 toward the outlet 118 with the debris 18 hitting the divider and bouncing back to the discharge pump outlet 118. By way of example, only the illustrated aperture 123 may be about 4 inches in diameter when the pump casing is about 22 inches in diameter and the blades have an outer diameter of 14 inches. In some instances, the ambient fluid 16 will be allowed to flow upwardly through the aperture 123 into the vortex generating chamber 121 in sufficient quantity to replace the liquid in the downwardly flowing vortex column 130. In other instances, where it is desired to provide a clean stream of liquid, such as water, within the vortex generating chamber, a clean stream of water may be flowed inwardly through a liquid pipe 126 into the vortex chamber to provide clean water and the rotating belt of outer pressure liquid 163 outwardly of the runner tip 160 will be generating a high pressure flow so as to limit the inward flow of liquid through the aperture 123. Thus, there will be very little, if any, ambient liquid flowing into the chamber 121 and the chamber 121 will be filled with substantially clean liquid from the inlet pipe 126.

It has been found that the nucleus 51 at the rotating belt of liquid 163 causes a fairly high pressure within the upper pump casing portion 114*a* which is attached to the top of the casing 114 which is generally of the shape shown in FIG. 1. To relieve this pressure it is preferred to provide a conduit or passageway 129 having an inner end with the chamber 121 and a lower outer end 129*a* connected to the outlet pipe 176 of the outlet 118. Thus, clean liquid may flow through the conduit 129 from the belt 163 traveling about the inner wall 133 of the upper casing 114*a*. Manifestly, other means of reducing the pressure within the vortex generating chamber 121 may be used.

Figure 8:
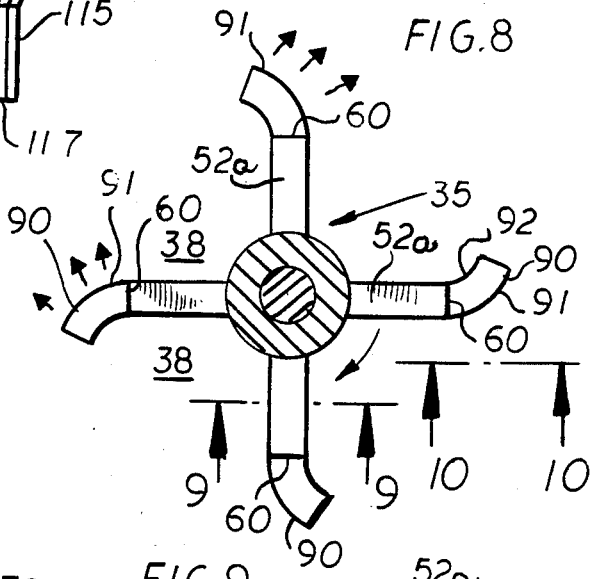
FIG. 8 illustrates a vortex generating runner in accordance with a still further embodiment of the invention.
Figure 9:
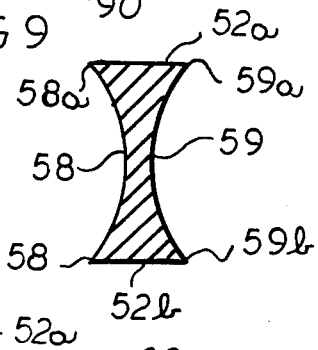
FIG. 9 is a cross-sectional view taken substantially along the line 9—9 of FIG. 8.
Figure 10:
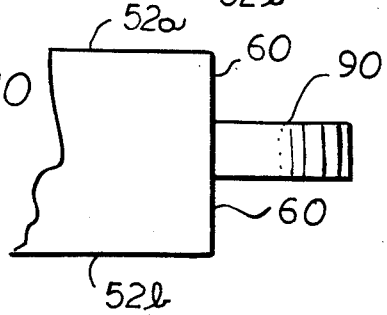
FIG. 10 is a view taken substantially in the direction of the arrows 10—10 in FIG. 8.

In accordance with a still further embodiment of the invention, the discharging liquid flowing through the outlet 18 of the pump shown in FIG. 1 may be given an additional boost by substituting the vortex generator 35*a* shown in FIG. 8 for the vortex generator shown in 2. The vortex generator 35*a* shown in FIG. 8 is similar to that shown in FIG. 8 except that there has been added at the outer tip 60 of the blades 35, a booster means in the form of curved fins or fingers 90; the curved fins or fingers 90 serve to throw the fluid outwardly in the direction 91 toward the outer casing wall and into the rotating belt 63 of liquid. Thus, when the blades 52*a* pass the elliptical discharge orifice 75 in the casing the liquid is given an impetus or force down the discharge pipe 76. As can be seen in FIGS. 8 and 9, the curved fingers 90 may be relatively short although they may be made as wide as the blades # between their top edges 52*a* and 52*b* as shown in FIG. 10. As seen in FIG. 9, the respective inner blade portions 52 have the curved surface 58 and 59 as above described in connection with FIG. 1. Herein, the booster fingers have curved surface 91 which have convex curved surfaces 91 on the leading side of rotation and have concave surfaces 92 on the trailing side of the direction of rotation.

Figure 11:
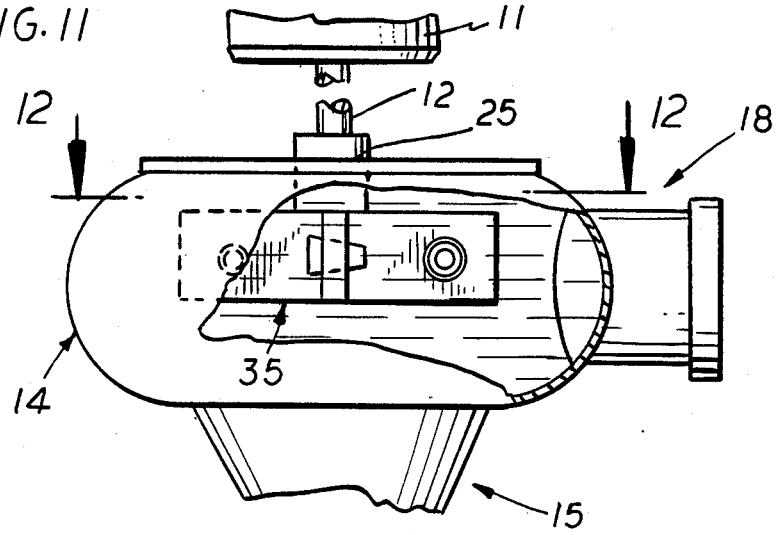
FIG. 11 illustrates another embodiment of the invention having pressure boosters in the vortex generating means.
Figure 12:
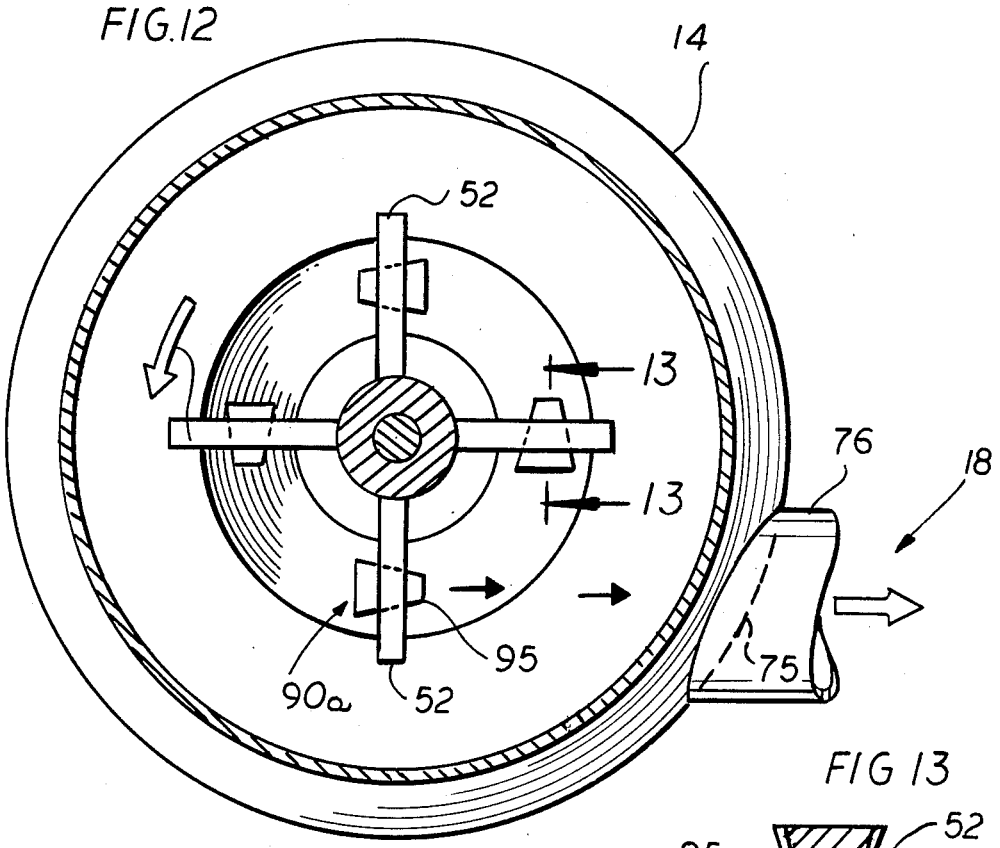
FIG. 12 is an enlarged cross-sectional view taken substantially along lines 12—12 in FIG. 11.
Figure 13:
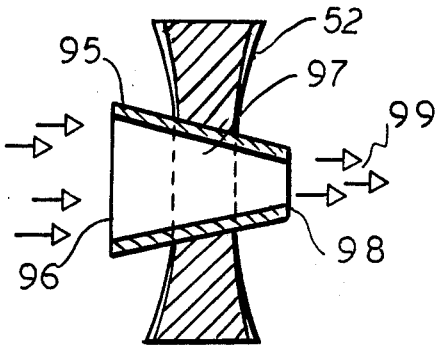
FIG. 13 is an enlarged cross-sectional view taken substantially along the line 13—13 in FIG. 12.

FIGS. 11–13 illustrate another embodiment of the invention in which the blades 52 have been provided with a booster means 90*a* which are in the form of nozzles 95 mounted in each of the blades 52. The nozzles have a frusto conical shape with a wider fluid inlet end 96 with the fluid being constricted to flow through a converging tapered bore 97 to exit a discharge end 98 with additional reaction thrust being provided to the blades 52 and as the blades travel past the discharge elliptical opening 75, the discharging reaction boost from the fluid shown by the direction arrows 99 will shoot down the hollow discharge pipe 76 to provide additional downstream thrust to push the swirling liquid downstream through the pipe 76.

Figure 7:
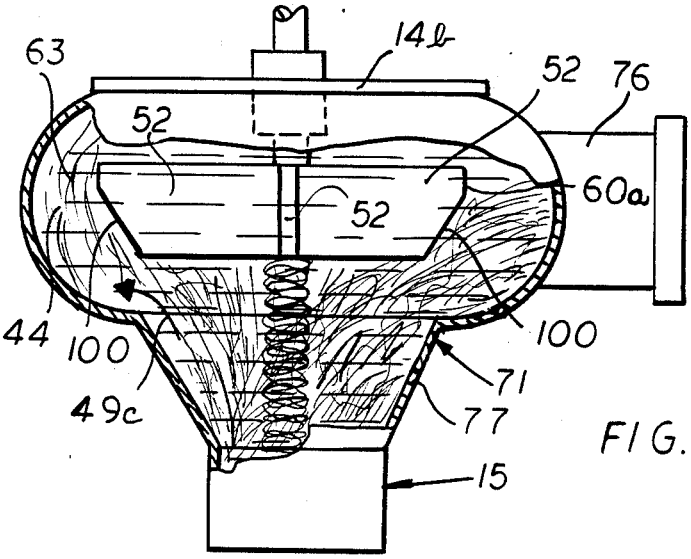
FIG. 7 illustrates another embodiment of the invention.

As shown in still another embodiment, the blades 52 may take varying shapes; and other illustrated shape for the blades as shown in FIG. 7 in which the blades are formed with tips 60*a* which have an inclined lower portion 100 which is substantially parallel to the inclined wall section 77 of the frusto conical inlet 71. Thus, the mainstream fluid flowing in from the inlet 15 and across to the discharge pipe 76 will have less interference with the lower edges of the blades 52 than is the case with the blades shown in FIG. 1 in which there are no lower inclined edges 100 on the blade. Also, more clearance is provided to allow rocks or other debris to pass under the blades without hitting the lower edges of the blades before flowing into the pump outlet 18.

The vortex generator 35 may be driven at very high speeds without cavitation in contrast to conventional centrifugal pumps which cavitate at speeds above 600 to 800 r.p.m. When the vortex generator 35 was used in dredging, the motor speed and the vortex generator speed was in the range of 1800 to 2000 r.p.m. without cavitation. The ability of the rotor to run at such high speeds without cavitation results in a number of benefits such as being able to drive the pump directly without the use of expensive and heavy speed reducers between the driving internal combustion motor in a dredge. In a dredge, the power source is typically a diesel engine running at 1800 to 2000 r.p.m. or higher. The turning of the vortex generator at high speeds causes high velocity flow through the pump e.g. in the aforesaid dredging operation velocities of 21 feet per second were obtained with the invention when the usual centrifugal pump would have velocities of about 14 feet per second. The increased velocity and turbulence from the swirling mixing action at the pump inlet results in higher solid content being pumped with this invention than with a centrifugal pump. The swirling of the solids and mainstream fluid through the inlet and outlet pipes organizes the solids and maintaining the solids in the swirl so that they have fewer collisions with the pipe walls and thereby reduces the frictional loss. In this dredging operation, an eight inch inlet pump of the present invention was able to dredge material at a rate comparable to a fourteen inch inlet centrifugal pump.

From the foregoing it will be seen that the present invention provides a new and improved pump having vortex generating means which is readily clogged, either because of its construction or because of the use of a divider to separate the vortex generating chamber to the discharge chamber to reduce the flow of debris into engagement with the rotating vortex generator. Also, the swirling flow is preferably guided across an inclined wall section from the inlet to the discharge outlet so as to eliminate a sharp right angle turn for the out-flowing fluid.

What is claimed is:

1. A pump apparatus for generating a rotating discharge of fluid comprising:

pump casing having an internal chamber for receiving fluid therein, vortex generating means for swirling fluid in the chamber to form synchronized vortex column flowing about a pre-determined axis to flow in first direction from the internal pump chamber, a pump inlet connected to the pump casing for receiving in the center thereof the vortex column of fluid being spun by the vortex generating means, the vortex column traveling to the throat of the pump inlet and causing rotation of the ambient fluid to flow inwardly through the inlet in a counter direction to the outward flow of the vortex column, a pump outlet on said casing for discharging the fluid, said inwardly flowing fluid having a swirling motion, and a tapered intake section on said pump inlet having a larger cross-sectional area at the pump casing and a smaller cross sectional area located toward the pump inlet, said tapered section having an inclined section between the pump inlet and pump outlet allowing the inward helically swirling fluid to swirl from the pump inlet across the inclined section and to helically swirl out the pump outlet.

2. A pump apparatus in accordance with claim 1 in which the pump outlet has an axis in a plane which is substantially perpendicular to axis through the pump inlet.

3. A pump apparatus in accordance with claim 2 in which said pump casing includes a generally annular, curved casing wall having a lower inlet opening, said tapered intake section being frustoconical in shape, said curved casing wall having an elliptically shaped aperture through which the helically swirling liquid discharges from the pump.

4. An apparatus in accordance with claim 1 in which said pump casing is generally bowl-shaped with a large, lower opening at which the upper end of the tapered inlet section is attached, said vortex generating means being located in the upper portion of said pump casing.

5. A pump apparatus for generating a rotating discharge of fluid comprising:

pump casing having an internal chamber for receiving fluid therein, vortex generating means for swirling fluid in the chamber to form a synchronized vortex column traveling about a pre-determined axis to flow in a first direction from the internal pump chamber, a pump inlet connected to the pump casing for receiving in the center thereof the vortex column of fluid being spun by the vortex generating means, the vortex column traveling to the throat of the pump inlet and causing rotation of the ambient fluid to flow inwardly through the inlet in a direction counter to the outward flow vortex column, said inwardly flowing fluid having a helical swirling motion, a pump outlet in said pump casing through which the helically swirling fluid flows from the pump casing, and a divider means in said pump casing dividing the pump chamber into a vortex generating chamber and a discharge chamber, said divider means having an aperture therein through which flows the vortex column fluid, said vortex generating means, the being located in the vortex generating chamber and said pump outlet being located in said discharge chamber.

6. An apparatus in accordance with claim 5 in which the pump casing includes a fluid inlet conduit connected to the vortex generator chamber for priming or providing clean fluid to the latter while the ambient fluid taken in the pump inlet flows through the discharge chamber without substantial flow through said aperture and into said vortex generator chamber.

7. An apparatus in accordance with claim 6 in which a pressure relieve passageway extends between the vortex generator chamber and the pump outlet to relieve the higher pressure being built up in the vortex generator chamber.

8. An apparatus in accordance with claim 7 in which the casing includes a lower bowl-shaped portion and in which the vortex generator chamber is a smaller chamber located on top of the bowl shaped chamber.

9. A pump apparatus in accordance with claim 8 in which said inlet is frustoconical in shape with an inclined wall across which the swirling liquid will flow from the inlet to the pump outlet.

10. A pump apparatus for generating a rotating discharge of fluid comprising:

pump casing having an internal chamber for receiving fluid therein, vortex means for swirling fluid in the chamber to form a synchronized vortex column traveling about a pre-determined axis to flow in a first direction from the internal pump chamber, a pump inlet connected to the pump casing for receiving in the center thereof the vortex column of fluid being spun by the vortex generating means, the vortex column traveling to the throat of the pump inlet and causing rotation of the ambient fluid to flow inwardly through the inlet in a direction counter to the outward flow vortex column, a pump outlet in said pump casing through which the helically swirling fluid floss from the pump casing, and said vortex generating means including a central rotating hub rotating about said predetermined axis and having a plurality of blades extending outwardly from the rotating hub, said runner blades being equally spaced and symmetrically and identical in shape so as to create a swirling nucleus of fluid extending between the blades and having upper and lower conical nucleus portions, said fluid flowing from the blades toward a common axis to form the vortex column.

11. A pump apparatus in accordance with claim 10 in which said blades extend radially outward from the hub and fluid pushing walls which are curved surfaces to direct the fluid towards a focused location.

12. A pump apparatus in accordance with claim 11 in which said pump blades have flat or narrower and thinner cross sections at the central portions of the blades than at the outer tip portions, each of said blades having said curved surfaces on opposite sides thereof.

13. An apparatus in accordance with claim 12 in which said curved surfaces are concave to catch and hold fluid therebetween.

14. An apparatus in accordance with claim 13 in which the radially outer free ends of the runner blades are wider in the circumferential direction than are the inner portions of the blades attached adjacent to the hub.

15. An apparatus in accordance with claim 10 in which pressure booster means are provided on the blades to provide a boost in pressure to the fluid being discharged.

16. An apparatus in accordance with claim 15 in which said pressure booster means comprises curved tips on the end of the runner blades for forcing fluid radially outwardly into an annular belt of high pressure located outwardly of the blade tips to add pressure to the discharging fluid flowing out the pump outlet means.

17. An apparatus in accordance with claim 15 in which said booster means comprises nozzles formed in the blades.

18. An apparatus in accordance with claim 10 in which lower edges of the runner blades have inclined walls, a conical pump inlet for the pump casing, having an inclined wall, said inclined walls on said runner blades being substantially parallel to said inclined wall on said pump inlet.

19. A method of pumping fluids comprising the steps of:

rotating a vortex generating means within a pump casing, causing fluid to flow annularly in a belt of positive pressure between the pump casing and a pump outlet, forming a nucleus of fluid in a generally ellipsoidal shape with an upper conical section above the generating means and a lower conical section below the vortex generating means, forming a rotating vortex column of fluid initially to travel down to the throat of the pump inlet from the lower conical section into the ambient fluid, swirling ambient fluid to rotate about the vortex column and to travel in an upward direction through the pump inlet, and discharging the swirling ambient fluid through a pump discharge while the fluid is flowing with a helical twist thereto.

20. A method in accordance with claim 19 including the step of rotating a plurality of equally spaced blades as the vortex generating means, the blades having open upper and lower ends to allow fluid to be retained in the nucleus between the blades and to interchange fluid with fluid in the upper and lower conical sections.

21. A method in accordance with claim 20 including the step of forming curved surfaces on the blades and retaining fluid within the nucleus by said curved surfaces.

22. A vortex generator for forming a nucleus of liquid, said vortex generator comprising:

a central hub having a rotational axis therethrough, a plurality of blades projecting radially outwardly from the hub, said blades being substantially identical in shape, said blades defining passageways therebetween having upper open ends and lower open ends to allow fluid to flow vertically between the blades and in said passageways.

23. A vortex generator in accordance with claim 22 in which said blades have radially extending faces, said faces being concave in shape between upper and lower edges to retain fluid in the nucleus.

24. A vortex generator in accordance with claim 22 in which radially outer free ends of said blades have curved surfaces thereon to hold fluid inwardly within the nucleus.

25. A vortex generator in accordance with claim 22 including booster means on said blades to deliver a boost increase in pressure to fluid discharging from the pump.

* * * * *

UNITED STATES PATENT AND TRADEMARK OFFICE

CERTIFICATE OF CORRECTION

PATENT NO. :4,792,275

DATED :December 20, 1988

INVENTOR(S) :HARRY P. WEINRIB

It is certified that error appears in the above-identified patent and that said Letters Patent is hereby corrected as shown below:

Column 1, Line 8, change "in" to --an--.
Column 2, Line 63, change "3" to --32--.
Column 3, Line 11, change "4,596,522" to --4,596,511--.
Column 3, Line 24, change "add" to --and--.
Column 3, Line 40, change "a" to --an--.
Column 3, Line 41, after "within" delete "in".
Column 4, Line 17, change "6" to --63--.
Column 4, Line 23, change "add" to --and--.
Column 5, Line 18, change "he" to --the--.
Column 5, Line 20, change "vorte" to --vortex--.
Column 5, Line 38, change "frusto conical" to --frustoconical--.
Column 5, Line 47, change "frusto-conical" to --frustoconical--.
Column 5, Line 49, change "add" to --and--.
Column 5, Line 51, change "72" to --7--.
Column 5, Line 51, change "frusto-conical" to --frustoconical--.
Column 5, Line 57, change "frusto conical" to --frustoconical--.
Column 6, Line 3, change "perview" to --purview--.
Column 6, Line 33, change "frusto conical" to --frustoconical--.
Column 7, Line 6, before "2" insert --FIG.--.
Column 7, Line 22, change "surface" to --surfaces--.
Column 7, Line 30, change "frusto conical" to --frustoconical--.
Column 7, Line 45, change "frusto conical" to --frustoconical--.

UNITED STATES PATENT AND TRADEMARK OFFICE

CERTIFICATE OF CORRECTION

PATENT NO. :4,792,275

DATED :December 20, 1988

INVENTOR(S) :HARRY P. WEINRIB

It is certified that error appears in the above-identified patent and that said Letters Patent is hereby corrected as shown below:

Column 9, Line 27, delete ", the".
Column 9, Line 38, change "relieve" to --relief--.
Column 9, Line 45, change "bowl shaped" to --bowl-shaped--.
Column 9, Line 67, change "floss" to --flows--.

Signed and Sealed this

Twenty-second Day of August, 1989

*Attest:*

*Attesting Officer*

DONALD J. QUIGG

*Commissioner of Patents and Trademarks*